US008959792B2

(12) United States Patent
Walker et al.

(10) Patent No.: US 8,959,792 B2
(45) Date of Patent: Feb. 24, 2015

(54) DRYERS THAT ADJUST POWER BASED ON NON-LINEAR PROFILES

(71) Applicants: Casey E. Walker, Boulder, CO (US); Scott Johnson, Erie, CO (US); Stuart J. Boland, Denver, CO (US); William Edward Manchester, Erie, CO (US); David M Price, Loveland, CO (US)

(72) Inventors: Casey E. Walker, Boulder, CO (US); Scott Johnson, Erie, CO (US); Stuart J. Boland, Denver, CO (US); William Edward Manchester, Erie, CO (US); David M Price, Loveland, CO (US)

(73) Assignee: Ricoh Company, Ltd., Tokyo (JP)

( * ) Notice: Subject to any disclaimer, the term of this patent is extended or adjusted under 35 U.S.C. 154(b) by 259 days.

(21) Appl. No.: 13/630,729

(22) Filed: Sep. 28, 2012

(65) Prior Publication Data

US 2014/0090267 A1 Apr. 3, 2014

(51) Int. Cl.
*F26B 3/00* (2006.01)

(52) U.S. Cl.
USPC ..... 34/282; 34/567; 101/424.1; 347/102

(58) Field of Classification Search
USPC ..... 34/275, 282, 550, 561, 570; 101/424.1, 101/487, 488; 347/16, 102
See application file for complete search history.

(56) References Cited

U.S. PATENT DOCUMENTS 4,032,817 A 6/1977 Richmond
4,833,488 A * 5/1989 Mizutani et al. ..... 347/205
4,970,528 A 11/1990 Beaufort et al.
5,214,442 A * 5/1993 Roller ..... 347/102
5,349,905 A 9/1994 Taylor et al.
5,467,119 A 11/1995 Richtsmeier et al.
5,479,199 A 12/1995 Moore et al.
5,500,667 A 3/1996 Schwiebert et al.
5,540,000 A * 7/1996 Rosenburgh et al. ..... 34/491
5,774,155 A 6/1998 Medin et al.
5,896,154 A 4/1999 Mitani et al.
5,930,551 A 7/1999 Nakazato
5,937,761 A 8/1999 Buschmann et al.
6,013,915 A * 1/2000 Watkins ..... 250/341.1
6,297,841 B1 10/2001 Takeda
6,401,358 B1 * 6/2002 Bar et al. ..... 34/266
6,450,712 B1 9/2002 Shah et al.
6,877,247 B1 * 4/2005 DeMoore ..... 34/269
7,401,911 B2 7/2008 Alfekri et al.
2005/0253912 A1 * 11/2005 Smith et al. ..... 347/102
2007/0130787 A1 * 6/2007 Moller et al. ..... 34/116
2007/0187027 A1 8/2007 Tausch
2009/0244160 A1 10/2009 Nakagaki
2010/0154244 A1 6/2010 Kuta et al.
2010/0192792 A1 8/2010 Hall
2014/0090267 A1 * 4/2014 Walker et al. ..... 34/282

FOREIGN PATENT DOCUMENTS

JP 62138249 6/1987

* cited by examiner

*Primary Examiner* — Steve M Gravini
(74) *Attorney, Agent, or Firm* — Duft Bornsen & Fettig LLP

(57) ABSTRACT

Systems and methods are provided for controlling a dryer of a printing system. The system comprises a controller and a sensor. The controller is operable to determine a speed of a web of print media traveling through a dryer, and to apply power to a heating element of the dryer based on a power profile that models a non-linear relationship between power applied to the heating element and speed of the web. The controller is further able to determine a type of media for the web, and to select the power profile based on the type of media.

20 Claims, 5 Drawing Sheets

DRYERS THAT ADJUST POWER BASED ON NON-LINEAR PROFILES

FIELD OF THE INVENTION

The invention relates to the field of printing systems, and in particular, to dryer units for printing systems.

BACKGROUND

In continuous-forms printing systems, one or more marking engines are used to apply marking material (e.g., aqueous ink) onto a web of print media. The web is driven through the marking engines and into a dryer. The dryer proceeds to heat the web and dry the marking material onto the web. The web moves quickly across the printing system in order to enable fast printing speeds. For example, the web may travel at many linear feet per second through the printing system. This means that dryers must either occupy a large space within the print shop or use a great deal of heat to dry the web. For example, in many dryers, inked portions of the web transit the entire length of the dryer in a fraction of a second.

In dryers that apply a great deal of heat over a short period of time, it remains a problem to ensure that the web is properly dried. Too much heat can cause charring at the web, which may break the web and halt printing operations. At the same time, too little heat can result in marking material on the web remaining wet, resulting in smearing or transfer of marking material that in turn reduces print quality.

Thus, printing system operators continue to desire dryers with enhanced functionality and reliability.

SUMMARY

Embodiments described herein control dryers for printing systems. These dryers use non-linear power profiles that specify an amount of power to apply to a heating element of the dryer based on the speed of a web of print media traveling through the dryer. These dryers may also select a power profile based on the type of media of the web. In some embodiments, the dryers may further deviate from the non-linear power profiles in response to determining that portions of the web exiting the dryer are too dry or too damp. This allows a dryer to adjust power based on the speed of the web, yet also allows the dryer to compensate for variations in ambient temperature, humidity, etc. at the print shop.

One embodiment is a system for controlling a dryer. The system comprises a controller. The controller is operable to determine a speed of a web of print media traveling through a dryer, and to apply power to a heating element of the dryer based on a power profile that models a non-linear relationship between power applied to the heating element and speed of the web. The controller includes separate power profiles for different types of media, and the controller is further operable to determine a type of media for the web, and to select the power profile based on the type of media.

Another embodiment is a method for controlling a dryer. The method comprises determining a speed of a web of print media traveling through a dryer, and determining a type of media for the web. The method further comprises selecting a power profile based on the type of media, and applying power to a heating element of the dryer based on the power profile, where the power profile models a non-linear relationship between power applied to the heating element and speed of the web.

Another embodiment is a non-transitory computer readable medium embodying programmed instructions which, when executed by a processor, are operable for performing a method. The method comprises determining a speed of a web of print media traveling through a dryer, and determining a type of media for the web. The method further comprises selecting a power profile based on the type of media, and applying power to a heating element of the dryer based on the power profile, where the power profile models a non-linear relationship between power applied to the heating element and speed of the web.

Other exemplary embodiments (e.g., methods and computer-readable media relating to the foregoing embodiments) may be described below.

DESCRIPTION OF THE DRAWINGS

Some embodiments of the present invention are now described, by way of example only, and with reference to the accompanying drawings. The same reference number represents the same element or the same type of element on all drawings.

DETAILED DESCRIPTION

The figures and the following description illustrate specific exemplary embodiments of the invention. It will thus be appreciated that those skilled in the art will be able to devise various arrangements that, although not explicitly described or shown herein, embody the principles of the invention and are included within the scope of the invention. Furthermore, any examples described herein are intended to aid in understanding the principles of the invention, and are to be construed as being without limitation to such specifically recited examples and conditions. As a result, the invention is not limited to the specific embodiments or examples described below, but by the claims and their equivalents.

Figure 1:
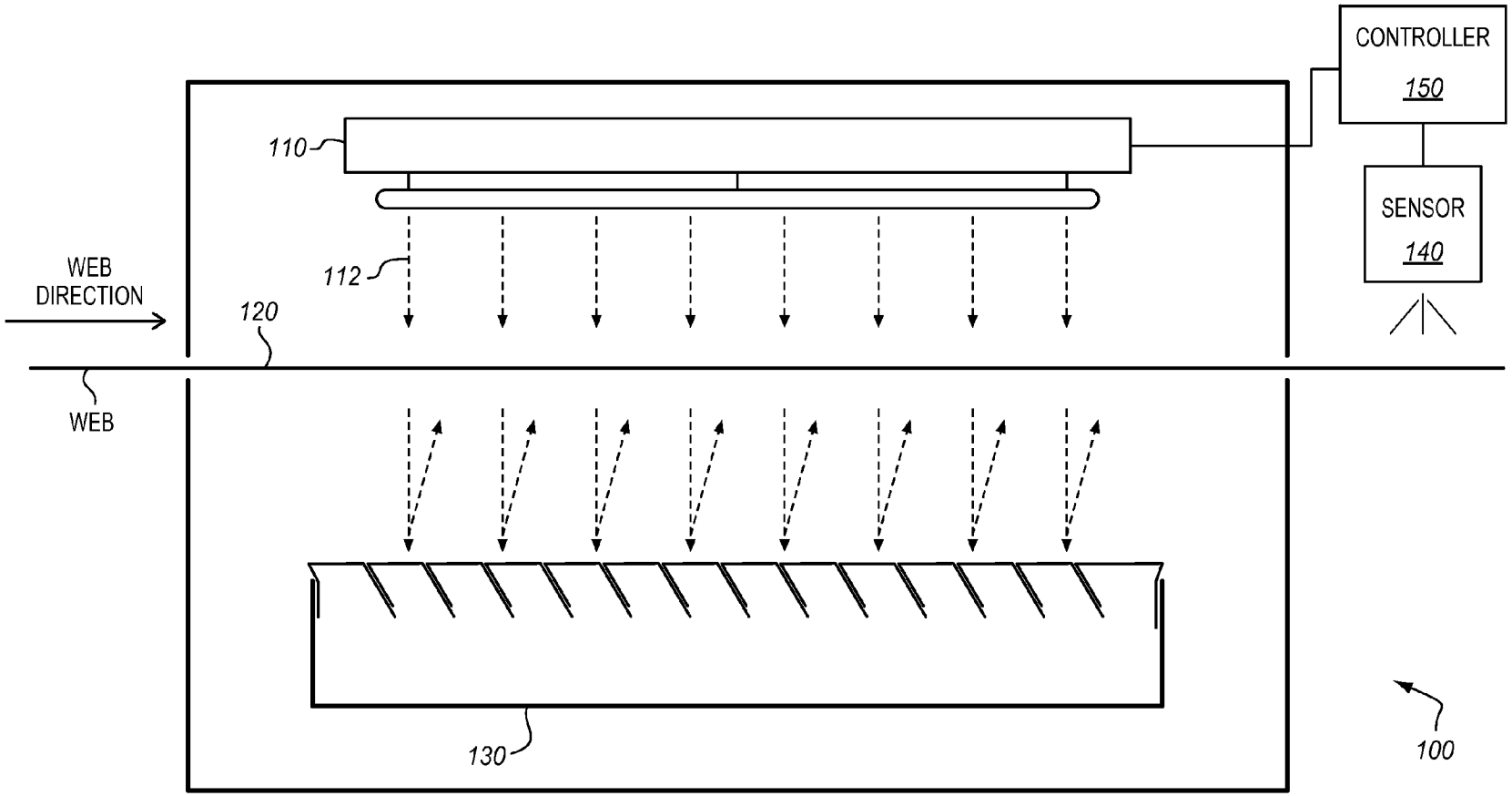
FIG. 1 is a block diagram of a drying system in an exemplary embodiment.

FIG. 1 is a block diagram of a drying system 100 of a print shop in an exemplary embodiment. While depicted as a separate element from an upstream printer in FIG. 1, drying system 100 may comprise an integrated component of a printer. After print heads of a printer have marked a web of print media, the wet, marked print media is driven towards drying system 100. Drying system 100 comprises any system, device, or component operable to dry the marking material applied by the upstream printer onto web 120. Drying system 100 has been enhanced to use non-linear power profiles to establish a baseline level of expected power needed to dry web 120. These power profiles vary the power based on the speed of web 120. The power profiles may further be generated offline and loaded onto drying system 100 without the need for a feedback sensor or inline process. Furthermore, in one embodiment drying system 100 can deviate from that baseline level of power in order to account for unexpected variations in ambient humidity, temperature, etc. in order to ensure optimal drying of web 120.

In this embodiment, drying system 100 includes heating element 110, reflector 130, sensor 140, and controller 150. Drying system 100 provides different levels of power to heating element 110 based on stored power profiles. Each power profile defines a different non-linear relationship between the speed of web 120 and power to apply to heating element 110. Thus, one power profile may be optimized for a certain type of media and/or marking material, while another power profile may be optimized for another type of media. Sensor 140 is capable of providing feedback indicating whether portions of web 120 have been sufficiently dried when they exit drying system 100. Based upon this feedback, in one embodiment drying system 100 can deviate the amount of power applied so that it is more or less than the amount suggested by the power profile.

Web 120 travels through drying system 100, and may comprise any suitable media capable of receiving marking material. For example, web 120 may comprise a web of paper. Depending upon the type of material used for web 120, it may take more or less energy to dry marking material onto web 120.

Heating element 110 is operable to generate radiant energy when it is powered. As web 120 travels through the interior of drying system 100, heating element 110 applies the generated radiant heat (indicated with element 112) to web 120 in order to heat web 120 and affix marking material onto it. Reflector 130 enhances the drying process by reflecting radiant heat from heating element 110 back towards web 120.

Controller 150 regulates the operations of heating element 110, and comprises any suitable system, component, or device operable to manage the amount of power directed to heating element 110 (e.g., by varying an applied power to heating element 110 as a function of the speed of web 120). For example, controller 150 may be implemented as a processor that implements programs stored in a memory. Controller 150 is capable of selecting a power profile from memory to use when drying web 120 (e.g., based on the type of media that web 120 is made from). Based on the speed of web 120, controller 150 can use the selected power profile to adjust the amount of power applied to heating element 110. Controller 150 is further capable of receiving feedback from sensor 140, and deviating from a selected power profile based on this feedback. This allows controller 150 to account for unexpected deviations in ambient room temperature, humidity, ink viscosity, and other factors.

Sensor 140 comprises any sensor capable of measuring a characteristic indicative of whether web 120 is dry as it leaves dryer 130. For example, sensor 140 may comprise a temperature sensor (e.g., a laser temperature sensor) that measures the temperature proximate to a surface of web 120. Controller 150 may then extrapolate the dampness of web 120 based upon a measured temperature reading. To ensure consistent temperature readings, sensor 140 may be set up to measure only marked or only unmarked portions of web 120. In other embodiments, sensor 140 may comprise a humidity sensor that measures a moisture content at web 120.

Further details of the operation of drying system 100 will be discussed with regard to FIG. 2. Assume, for this embodiment, that a print shop operator wishes to initiate printing of a print job onto web 120. The operator may contact controller 150 (e.g., via a user interface or remote client), and select the material that web 120 is made of. The operator may further indicate the type of marking material that will be printed onto web 120. Controller 150 may then select a power profile to use when drying web 120 based on the operator's input (e.g., based on input indicating the material of web 120 and/or type of marking material used). In a further embodiment, controller 150 may select a power profile based upon input from a job ticket, based on a message from a print server, or even based on an analysis of the print data itself for specific metadata or other information.

Next, a printer upstream from drying system 100 initiates printing onto web 120. During the printing process, web 120 is driven downstream toward drying system 100. The damp printed portions of web 120 are therefore moved from the printer and into drying system 100.

Figure 2:
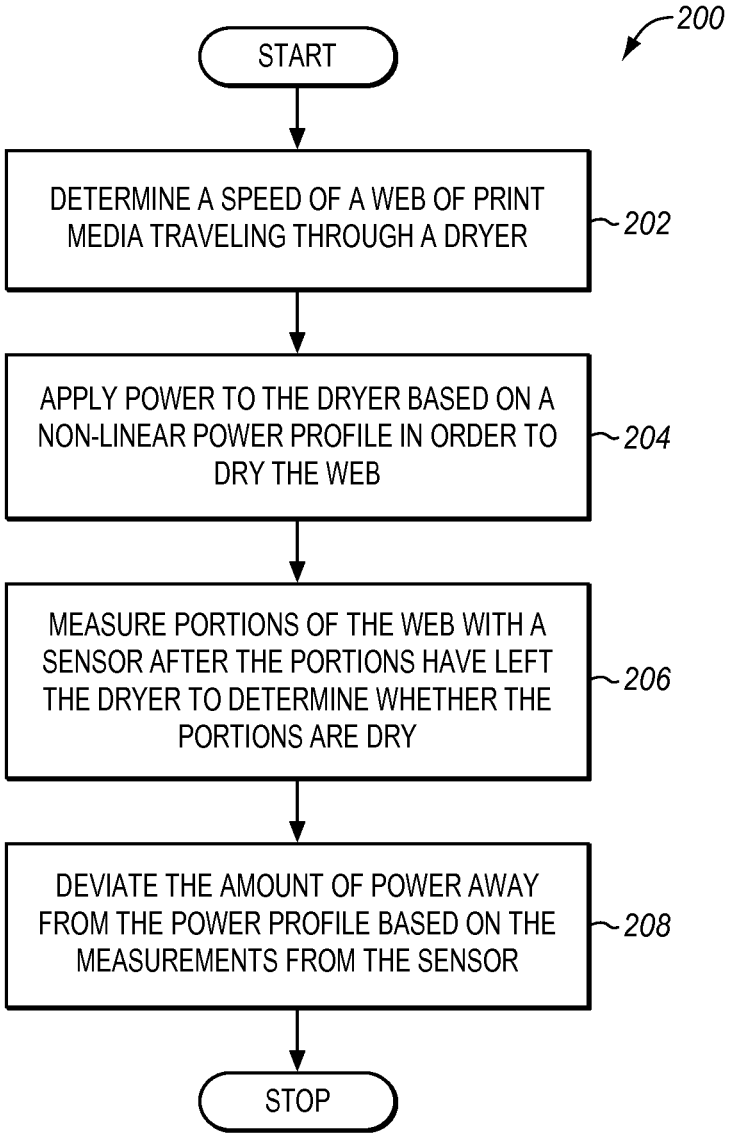
FIG. 2 is a flowchart illustrating a method for drying a web of print media in an exemplary embodiment.

FIG. 2 is a flowchart illustrating a method 200 for drying a web of print media in an exemplary embodiment. The steps of method 200 are described with reference to drying system 100 of FIG. 1, but those skilled in the art will appreciate that method 200 may be performed in other systems. The steps of the flowcharts described herein are not all inclusive and may include other steps not shown. The steps described herein may also be performed in an alternative order.

In step 202, controller 150 determines a speed of web 120 as it travels through drying system 100. This action may be performed by querying a networked printing server to retrieve the speed, by reading one or more sensors within the print shop (e.g., at an entrance or exit of drying system 100), or by physically measuring the speed of the web. Physically measuring web speed may comprise measuring a rotational velocity of one or more rollers, or using a linear velocity sensor to measure actual web speed.

In step 204, controller 150 applies power to heating element 110 in order to dry web 120. The amount of power is chosen based upon the selected power profile. This power profile may be defined by one or more equations, or may be defined as a series of empirically determined data points stored in memory. The equations and/or points may be used by controller 150 to determine a relationship between speed for web 120 and power applied to heating element 110. If the power profile is defined as a series of data points, then controller 150 may perform an interpolation (e.g., linear, quadratic, etc.) between points to determine a power to apply to heating element 110 at a given speed. Applying power may be performed, for example, by changing the voltage applied to heating element 110.

In step 206, sensor 140 optionally measures portions of web 120 while/after these portions of web 120 leave drying system 100. The measurement is performed to determine whether these portions of web 120 are still damp. Sensor 140 may measure the temperature of web 120 as it exits dryer 130, the humidity at web 120, etc.

Marked portions of web 120 can be heated to much higher temperatures than unmarked portions of web 120, because their spectral absorption properties will be different. Marked portions of web 120 will therefore absorb a different amount of radiant heat. Therefore, sensor 140 can be calibrated to consistently measure either marked or unmarked portions (e.g., margins) of web 120 so that the measurements do not unexpectedly change.

In one embodiment, controller 150 analyzes the measurements from sensor 140 to determine if web 120 is within appropriate bounds of dryness/dampness when it exits drying system 100. If web 120 is too dry, there may be a risk of fire or discoloration of the printed media. At the same time, if web 120 is too damp, then marking material (e.g., ink) on web 120 may smear when web 120 is driven downstream of drying system 100, or is stored at the print shop. Therefore, if web 120 is over a threshold for dryness or below a threshold for dampness, it may be desirable to adjust the power applied to heating element 110 to get web 120 as dry as desired. These thresholds vary based on the power profile, as one type of print material for a web may use more or less power to achieve the same level of dryness than another type of print material for a web.

In step 208, controller 150 optionally deviates the power applied to heating element 110 away from the power profile to account for web 120 being too dry or too damp. Steps 206 and 208 may be performed iteratively, such that multiple small changes are made to the power applied to heating element 110 over time. For example, if the web is too dry, controller 150 may substantially reduce the amount of applied power to eliminate fire risk, and may then slowly increase the applied power over time to reach an optimum level of drying.

Using method 200, drying system 100 can more effectively dry a web of print media. For example, controller 150 can initially establish a baseline level of expected power needed to dry the web based on the power profile. Furthermore, controller 150 can in further embodiments deviate from that baseline level of power in order to account for unexpected variations in ambient humidity, temperature, etc., and ensure optimal drying.

Figure 3:
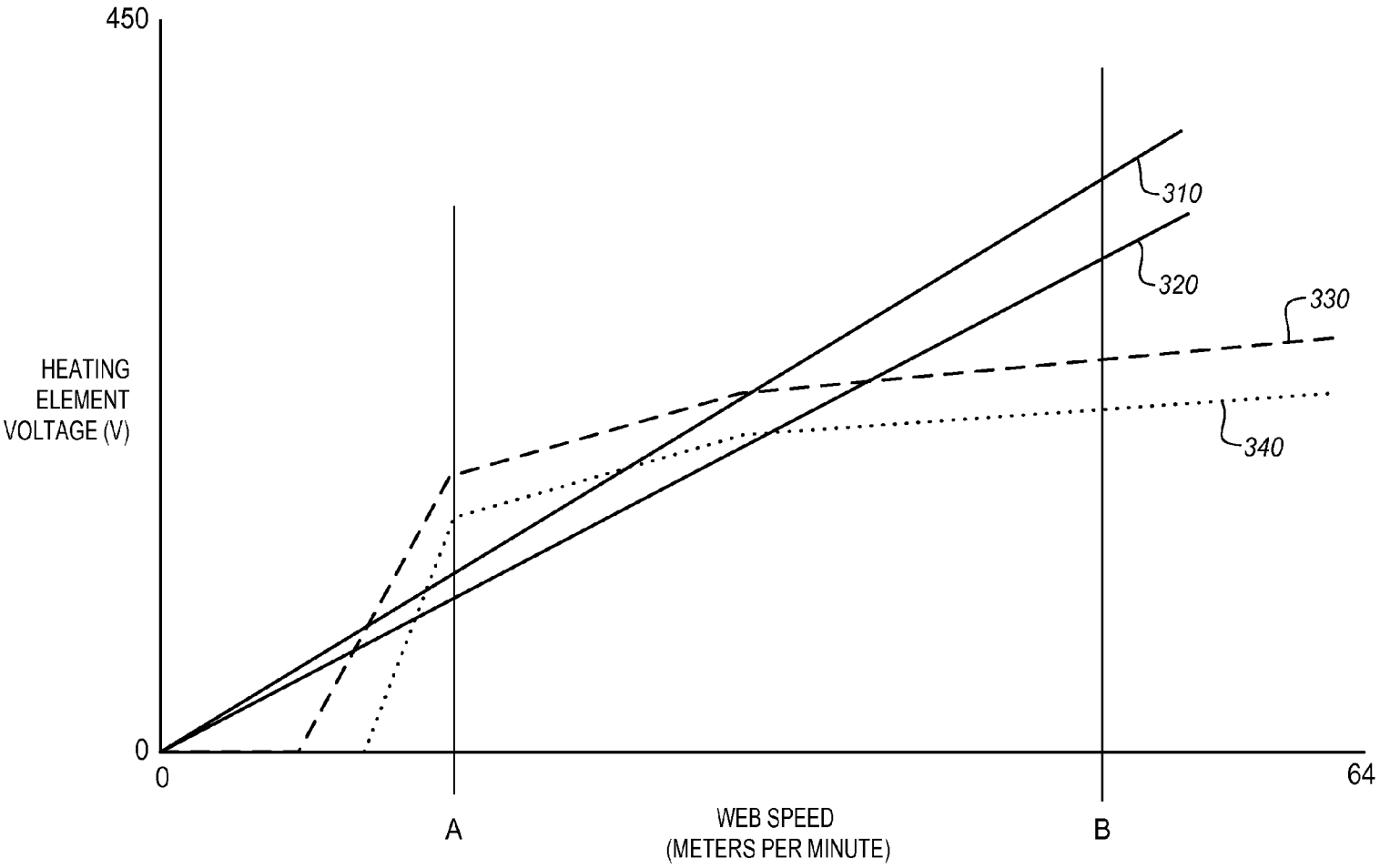
FIG. 3 is a block diagram illustrating various power profiles for dryer systems in an exemplary embodiment.

FIG. 3 is a block diagram illustrating various power profiles for dryer systems in an exemplary embodiment. In each of the power profiles, a power applied to a radiant heater is correlated with a linear speed of a web of print media. FIG. 3 includes two profiles 310 and 320, which are linear power profiles. Linear profile 310 is optimized for low-speed printing, while linear profile 320 is optimized for high-speed printing. For linear profiles, at lower printing speeds (e.g., speed "A") the web is left damp and underheated. At high speeds however, (e.g., speed "B") the web is overheated and risks igniting a fire. Non-linear profiles 330 and 340 utilize fixed operating points that indicate a desired voltage to apply for a given speed of printing. A controller may then use interpolation (e.g., linear, quadratic, etc.) to estimate between these fixed operating points. The overall function for applied voltage is therefore not a linear one.

Figure 4:
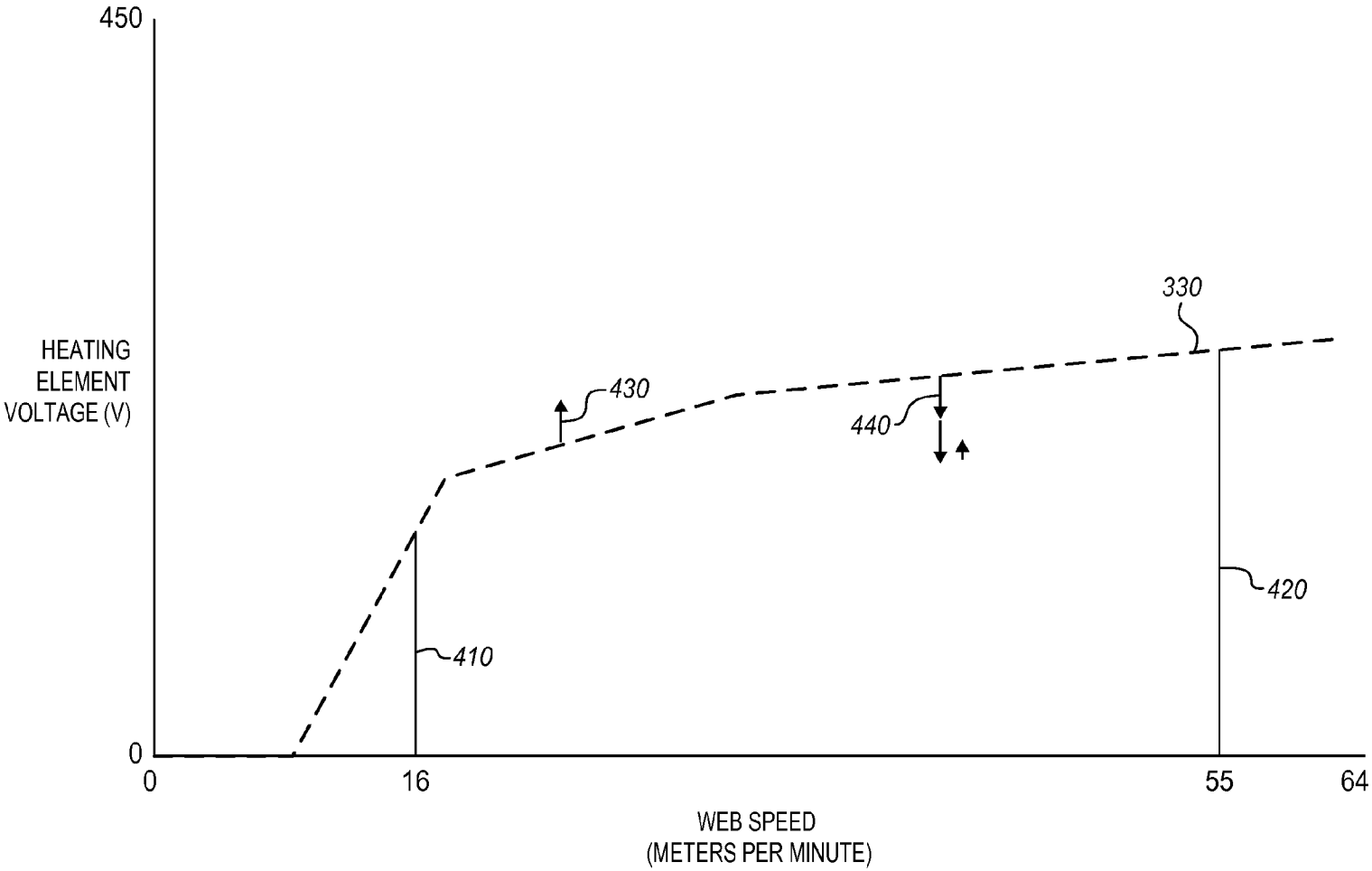
FIG. 4 is a block diagram illustrating modifications applied to a power profile for a dryer system in an exemplary embodiment.

FIG. 4 is a block diagram illustrating modifications applied to a power profile 330 for a dryer system in an exemplary embodiment. According to FIG. 3, non-linear profile 330 has been modified by controller 150 of FIG. 1 to exhibit altered behavior. For example, controller 150 has modified its use of profile 330 to include cut-off points 410 and 420. In this example, controller 150 leaves heating element 110 powered off when the speed exceeds cutoff 420 or drops below cutoff 410. Powering off heating element 110 at low speeds ensures that if web 120 comes to a stop, latent heat from heating element 110 will not burn web 120 as it rests within the dryer. Powering off heating element 110 at high speeds ensures that design thresholds for optimal operation of heating element 110 are not exceeded.

FIG. 4 also shows deviations from power profile 330. At location 430, a measurement made by sensor 140 of FIG. 1 (indicating that the web is too damp) has caused controller 150 to increase the amount of voltage applied to a radiant heater in order to make the web more dry, even though the speed of the web is relatively slow. This may be appropriate when the ambient humidity of the print shop is unexpectedly high.

Location 440 indicates a different printing scenario where printing occurs at a different speed. In this scenario, a measurement made by a sensor (indicating that the web is too hot) has caused controller 150 to decrease the voltage applied to heating element 110 in order to make the paper less dry and less likely to catch fire. Controller 150 then pauses for the system to stabilize (e.g., for ten seconds, a fraction of a second, etc. depending on web speed and/or sensor placement) and takes another measurement from sensor 140. Controller 150 then determines from the sensor input that the web is still too dry, and drops the voltage again. Controller 150 waits again and takes another reading. This time, controller 150 determines that the web is too damp, and performs a minor increase in voltage applied to heating element 110. This adjusts the voltage to ensure that web 120 is dry but not dangerously hot (e.g., 400° F.) when it leaves the dryer. This voltage adjustment process may be continuously performed until the print job has completed.

In a further embodiment, controller 150 may continuously sample the printing speed for a given job, and may dynamically adjust the voltage applied to a radiant heater whenever the printing speed changes during printing of the job. This may be advantageous in situations where a printer slows down the speed of a web in order to account for increased rasterization time for complex segments of print data. This may also be advantageous when manual print quality verification is performed by a print shop operator.

In a further embodiment, controller 150 may take advantage of the observation that marked portions of a web of print media become much hotter than unmarked portions. In this embodiment, when the dryer initializes, it initializes by receiving unmarked, blank portions of a web. The controller may therefore "pre-heat" the dryer before a print job is initiated. During this pre-heat process, controller 150 may increase the power applied to heating element 110 to the point where marked portions of the web would ignite due to the applied radiant heat emanating from heating element 110 (i.e., regardless of the current operating temperature of the dryer).

This pre-heat power may continue until the print job initiates and printed portions of the web start traveling nearing the dryer. At this point, controller 150 may drop the amount of power applied to heating element 110 to keep it from igniting the printed portions of the web as they travel through the dryer. Controller 150 may determine that printed portions of the web are nearing the dryer based on a known speed of the web and a known distance from the printer to the web. The pre-heat process herein discussed enables the dryer (and downstream web handling components) to rapidly reach a desired operating temperature whenever a new print job is initiated.

In a further embodiment, controller 150 performs a linear interpolation between voltages defined by the power profile. For example, controller 150 may detect the printing speed ($S_{current}$) by querying the printer, and then select two operating points within the power profile. The first operating point ($V_1$) is at a speed ($S_1$) below the printing speed, while the second operating point ($V_2$) is at a speed ($S_2$) above the printing speed. Controller 150 interpolates a voltage to apply by using the following formula:

$$V_{current}=V_1+(V_1-V_1)*(S_{current}-S_1)/(S_2-S_1)$$

Figure 5:
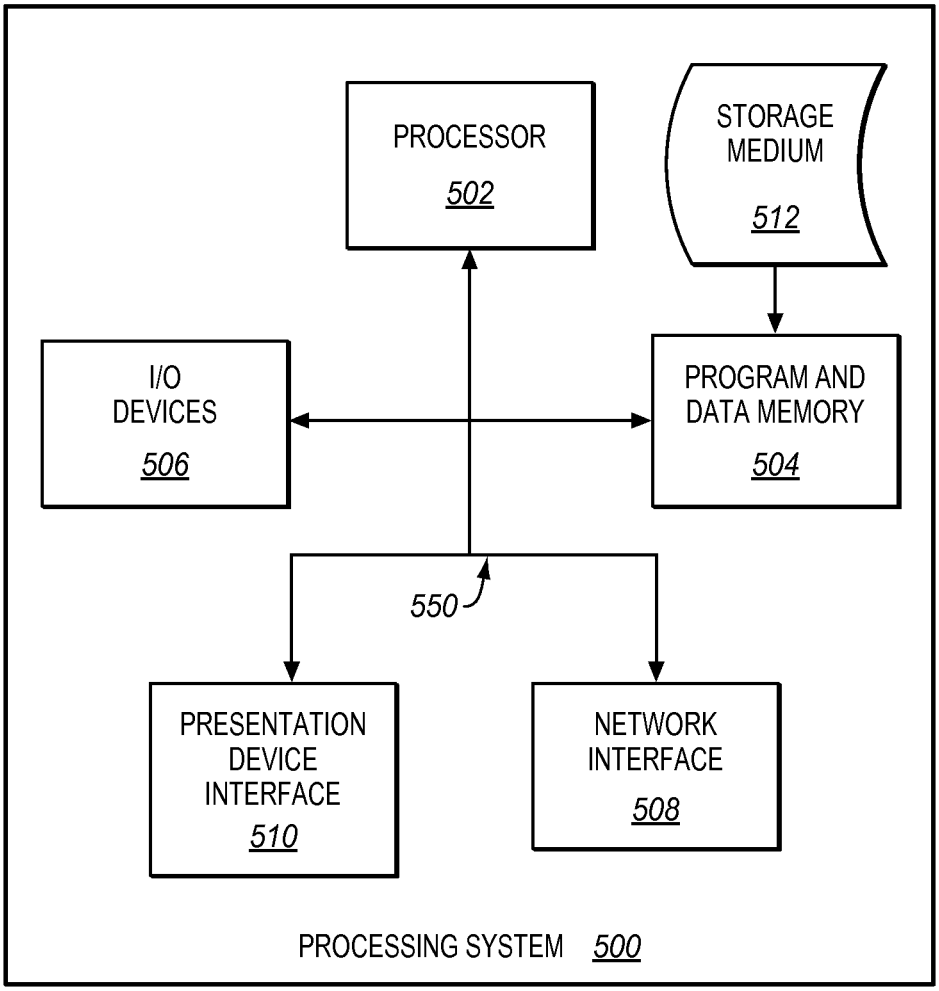
FIG. 5 illustrates a processing system operable to execute a computer readable medium embodying programmed instructions to perform desired functions in an exemplary embodiment.

Embodiments disclosed herein can take the form of software, hardware, firmware, or various combinations thereof. In one particular embodiment, software is used to direct a processing system of drying system 100 to perform the various operations disclosed herein. FIG. 5 illustrates a processing system 500 operable to execute a computer readable medium embodying programmed instructions to perform desired functions in an exemplary embodiment. Processing system 500 is operable to perform the above operations by executing programmed instructions tangibly embodied on computer readable storage medium 512. In this regard, embodiments of the invention can take the form of a computer program accessible via computer-readable medium 512 providing program code for use by a computer or any other instruction execution system. For the purposes of this description, computer readable storage medium 512 can be anything that can contain or store the program for use by the computer.

Computer readable storage medium 512 can be an electronic, magnetic, optical, electromagnetic, infrared, or semiconductor device. Examples of computer readable storage medium 512 include a solid state memory, a magnetic tape, a removable computer diskette, a random access memory (RAM), a read-only memory (ROM), a rigid magnetic disk, and an optical disk. Current examples of optical disks include compact disk-read only memory (CD-ROM), compact disk-read/write (CD-R/W), and DVD.

Processing system 500, being suitable for storing and/or executing the program code, includes at least one processor 502 coupled to program and data memory 504 through a system bus 550. Program and data memory 504 can include local memory employed during actual execution of the program code, bulk storage, and cache memories that provide temporary storage of at least some program code and/or data in order to reduce the number of times the code and/or data are retrieved from bulk storage during execution.

Input/output or I/O devices 506 (including but not limited to keyboards, displays, pointing devices, etc.) can be coupled either directly or through intervening I/O controllers. Network adapter interfaces 508 may also be integrated with the system to enable processing system 500 to become coupled to other data processing systems or storage devices through intervening private or public networks. Modems, cable modems, IBM Channel attachments, SCSI, Fibre Channel, and Ethernet cards are just a few of the currently available types of network or host interface adapters. Presentation device interface 510 may be integrated with the system to interface to one or more presentation devices, such as printing systems and displays for presentation of presentation data generated by processor 502.

Although specific embodiments were described herein, the scope of the invention is not limited to those specific embodiments. The scope of the invention is defined by the following claims and any equivalents thereof.

We claim:

1. A system comprising:

a controller operable to determine a speed of a web of print media traveling through a dryer, and to apply power to a heating element of the dryer based on a power profile that models a non-linear relationship between power applied to the heating element and speed of the web, wherein the controller includes separate power profiles for different types of media, and the controller is further operable to determine a type of media for the web, and to select the power profile based on the type of media.

2. The system of claim 1 further comprising:

a sensor operable to measure portions of the web exiting the dryer to determine whether the portions are dry.

3. The system of claim 2 wherein:

the sensor is operable to measure a temperature of the web.

4. The system of claim 2 wherein:

the sensor is operable to measure a humidity of the web.

5. The system of claim 2 wherein:

the controller is further operable to deviate the power applied to the heating element away from the power profile based on measurements from the sensor.

6. The system of claim 5 wherein:

the controller is further operable to deviate the power applied to the heating element by identifying a first power in the power profile for a slower speed, identifying a second power in the power profile for a faster speed, and interpolating between the first and second powers.

7. The system of claim 1 wherein:

the controller is further operable to pre-heat the dryer by powering the heating element to generate radiant heat that would ignite printed portions of the web, to detect that printed portions of the web are about to enter the dryer, and to reduce the power applied to the heating element before the printed portions reach the dryer.

8. The system of claim 1 wherein:

the controller is further operable to detect that the speed of the web of media has changed during printing, and to adjust the power applied to the heating element based on the power profile in order to facilitate drying as the web travels through the dryer at the changed speed.

9. A method comprising:

determining a speed of a web of print media traveling through a dryer;

determining a type of media for the web;

selecting a power profile based on the type of media; and applying power to a heating element of the dryer based on the power profile, where the power profile models a non-linear relationship between power applied to the heating element and speed of the web.

10. The method of claim 9 further comprising:

measuring portions of the web that are exiting the dryer with a sensor to determine whether the portions are dry; and deviating the power applied to the heating element away from the power profile based on the measurements from the sensor.

11. The method of claim 10 wherein:

measuring portions of the web with a sensor comprises measuring a temperature of the web with the sensor.

12. The method of claim 10 wherein:

measuring portions of the web with a sensor comprises measuring a humidity of the web with the sensor.

13. The method of claim 10 wherein:

deviating the power applied to the heating element comprises:

identifying a first power in the power profile for a slower speed;

identifying a second power in the power profile for a faster speed; and interpolating between the first and second powers.

14. The method of claim 9 further comprising:

pre-heating the dryer by powering the heating element to generate radiant heat that would ignite printed portions of the web;

detecting that printed portions of the web are about to enter the dryer; and reducing the power applied to the heating element before the printed portions reach the dryer.

15. The method of claim 9 further comprising:

detecting that the speed of the web of media has changed during printing; and adjusting the amount of power applied to the heating element based on the power profile in order to facilitate drying as the web travels through the dryer at the changed speed.

16. A non-transitory computer readable medium embodying programmed instructions which, when executed by a processor, are operable for performing a method comprising:

determining a speed of a web of print media traveling through a dryer;

determining a type of media for the web;

selecting a power profile based on the type of media; and applying power to a heating element of the dryer based on the power profile, where the power profile models a non-linear relationship between power applied to the heating element and speed of the web.

17. The medium of claim 16, the method further comprising:

measuring portions of the web that are exiting the dryer with a sensor to determine whether the portions are dry; and deviating the power applied to the heating element away from the power profile based on the measurements from the sensor.

18. The medium of claim 17 wherein:

measuring portions of the web with a sensor comprises measuring a temperature of the web with the sensor.

19. The medium of claim 17 wherein:

measuring portions of the web with a sensor comprises measuring a humidity of the web with the sensor.

20. The medium of claim 17 wherein:

deviating the power applied to the heating element comprises:

identifying a first power in the power profile for a slower speed;

identifying a second power in the power profile for a faster speed; and interpolating between the first and second powers.

* * * * *